US010557683B1

(12) United States Patent
Staffetti

(10) Patent No.: US 10,557,683 B1
(45) Date of Patent: Feb. 11, 2020

(54) CONTROLLABLE FIRING PATTERN FIREARM SYSTEM

(71) Applicant: Joseph Staffetti, Oldsmar, FL (US)

(72) Inventor: Joseph Staffetti, Oldsmar, FL (US)

( * ) Notice: Subject to any disclaimer, the term of this patent is extended or adjusted under 35 U.S.C. 154(b) by 136 days.

(21) Appl. No.: 15/891,601

(22) Filed: Feb. 8, 2018

(51) Int. Cl.
*F41G 3/04* (2006.01)
*F41G 5/00* (2006.01)

(52) U.S. Cl.
CPC *F41G 3/04* (2013.01); *F41G 5/00* (2013.01)

(58) Field of Classification Search
CPC ..... F41G 3/04; F41G 5/00
See application file for complete search history.

(56) References Cited

U.S. PATENT DOCUMENTS 4,011,789 A 3/1977 Bresee, Jr. et al.
4,244,272 A * 1/1981 Terry ..... F41G 3/04 89/41.16
4,386,303 A 5/1983 Kleptz et al.
4,924,753 A 5/1990 Tassie et al.
5,413,025 A 5/1995 Martin
5,949,015 A 9/1999 Smith et al.
7,146,898 B2 12/2006 O'Dwyer
7,210,392 B2 * 5/2007 Greene ..... F41G 3/06 89/1.11
7,549,367 B2 * 6/2009 Hill ..... F41A 27/30 89/136
7,963,442 B2 6/2011 Jenkins et al.
8,234,968 B2 * 8/2012 Hodge ..... F41A 27/06 89/37.17
8,276,496 B2 10/2012 Garwood
8,375,620 B2 2/2013 Staley, III
2015/0226523 A1 8/2015 Batchvarov
2015/0300765 A1 * 10/2015 Choi ..... F41G 3/12 89/6.5
2016/0305740 A1 10/2016 O'Donnell et al.

* cited by examiner

*Primary Examiner* — J. Woodrow Eldred
(74) *Attorney, Agent, or Firm* — Williams Intellectual Property; Timothy Snyder

(57) ABSTRACT

A controllable firing pattern firearm system is described herein. The controllable firing pattern firearm system includes a firearm, one or more actuators for adjusting at least one of a position and orientation of the firearm, and a controller controlling the actuators to produce a designated firing pattern on a target as the firearm is fired. The controller receives several user inputs to generate the commands for the actuators to produce the designated firing pattern, where the designated firing pattern may be a spiral firing pattern. The user provides input through a control panel having several control input mechanisms. The user inputs include a firing pattern size or target diameter, projectile firing density, and a distance of a target from the firearm, among other inputs. A method is also described herein for firing a spiral firing pattern on a target with the controllable firing pattern firearm system.

18 Claims, 5 Drawing Sheets

CONTROLLABLE FIRING PATTERN FIREARM SYSTEM

BACKGROUND OF THE INVENTION

Various types of firearms are known in the prior art. For example, a Gatling gun (Mini-gun) is a six-barrel, electrically driven machine gun capable of firing 7.62 mm projectiles at a fixed rate of 3,000 rounds per minute, such as the Dillon M134D Gatling gun. These machine guns are typically used as helicopter crew-served firearms, or fixed forward fire installations on helicopters or fixed-wing aircraft. The machine gun is also used on board vehicles and ships. The machine gun is advantageous as the gun can fire thousands of rounds per minute towards a target increasing the odds of destroying the target. However, the gun is only as accurate as the operator's skill in aiming the gun. As such, small and fast moving targets (e.g., drones, fighter jets) are particularly difficult to destroy as the gun needs to be quickly adjusted and aimed towards a small target area. Likewise, large targets (e.g., missile launch pads) may be difficult to destroy as the gun needs to be precisely aimed towards several locations on the target to fully destroy the target.

Thus, there exists a need in the art to improve the probability of hitting and destroying a target with a firearm by providing a controllable firing pattern firearm system capable of firing projectiles across a wider area of the target in a controlled fashion.

FIELD OF THE INVENTION

The present invention generally relates to the field of firearms, and more particularly, to a controllable firing pattern firearm system capable of firing projectiles at a target in a designated firing pattern.

SUMMARY OF THE INVENTION

The general purpose of the controllable firing pattern firearm system, described subsequently in greater detail, is to provide a controllable firing pattern firearm system which has many novel features that result in a controllable firing pattern firearm system which is not anticipated, rendered obvious, suggested, or even implied by prior art, either alone or in combination thereof.

A controllable firing pattern firearm system is provided including a firearm, one or more actuators operatively coupled to the firearm to adjust at least one of a position and orientation of the firearm, and a controller controlling the one or more actuators to produce a designated firing pattern on a target as the firearm is firing. The designated firing pattern may be a spiral firing pattern where the controller commands the actuators to produce the spiral firing pattern by beginning at a center point of a spiral, spiraling the firearm outwards to a maximum diameter, then spiraling the firearm inwards back to the center point.

A control panel includes a plurality of control input mechanisms to permit a user to provide user input to control the firearm. The control panel may include a first control input mechanism to permit a user to adjust projectile firing density, a second control input mechanism to toggle between a non-pattern firing mode and a pattern firing mode, a third control input mechanism to permit a user to input a size of the firing pattern (i.e., size of the target), a fourth control input mechanism to toggle between a single cycle firing mode and a continuous cycle firing mode, and a fifth control input mechanism to permit the user to adjust a distance measurement between the firearm and a target. A joystick is further provided for facilitating the aiming of the firearm towards a target. The joystick further includes a dial to input/adjust at least one of a size of the firing pattern (i.e. size of target), projectile firing density, a firing pattern mode, a cycle firing mode, or a distance from the firearm to a target. A distance measurement sensor is also provided in data communication with the controller. The distance measurement sensor measures a distance from the firearm to a target, where the controller utilizes a measured distance from the firearm to a target to produce the designated firing pattern on the target.

The controllable firing pattern firearm system may further include a heads-up-display unit, said heads-up-display unit in data communication with the controller to provide data to the user including at least one of a designated firing pattern, a distance of a target from the firearm, a size of the firing pattern, projectile firing density, firing cycle, available ammunition, and an amount of ammunition to be expended in a next firing cycle.

The controllable firing pattern firearm system may further include a platform and a stand. A rotary actuator is positioned between the platform and the stand to rotate the stand relative to the platform. A support assembly is disposed on the stand and supports a first portion of the firearm. A linear actuator is also disposed on the stand and coupled to a second portion of the firearm. The rotary actuator and linear actuator adjusts an orientation of the firearm to produce the designated firing pattern based on commands from the controller. The support assembly may include one or more brackets each having a first end connected to the stand and a second end assembled to the firearm by a hinge to permit the firearm to rotate about the hinge relative to the one or more brackets. The linear actuator may further be coupled to the second portion of the firearm by a second hinge.

Alternatively, the controllable firing pattern firearm system may include a Gough-Stewart platform operated by the one or more actuators, wherein the firearm is operatively coupled to the Gough-Stewart platform to adjust at least one of a position and orientation of the firearm to produce the designated firing pattern based on commands from the controller.

A method for firing a spiral firing pattern on a target with the controllable firing pattern firearm is also provided. The method includes determining a distance from the firearm to a target and inputting that distance in the controller. Inputting a desired projectile firing density in the controller, and a desired size of the firing pattern in the controller based on a size of the target. Calculating commands for the one or more actuators to produce a spiral firing pattern based on the distance, the size, and the firing density. And firing the firearm at the target, wherein the actuators, based on commands from the controller, adjust the firearm to produce the spiral firing pattern on the target.

Thus has been broadly outlined the more important features of the present controllable firing pattern firearm system so that the detailed description thereof that follows may be better understood and in order that the present contribution to the art may be better appreciated.

Objects of the present controllable firing pattern firearm system, along with various novel features that characterize the invention are particularly pointed out in the claims forming a part of this disclosure. For better understanding of the controllable firing pattern firearm system, its operating advantages and specific objects attained by its uses, refer to the accompanying drawings and description.

BRIEF DESCRIPTION OF THE DRAWINGS

In the figures, identical structures, elements or parts that appear in more than one figure are generally labeled with a same numeral in all the figures in which they appear. Dimensions of components and features shown in the figures are generally chosen for convenience and clarity of presentation and are not necessarily shown to scale. The figures are listed below.

FIG. 6A is a perspective view thereof, and FIG. 6B is a side view thereof.

DETAILED DESCRIPTION OF THE DRAWINGS

Figure 1A:
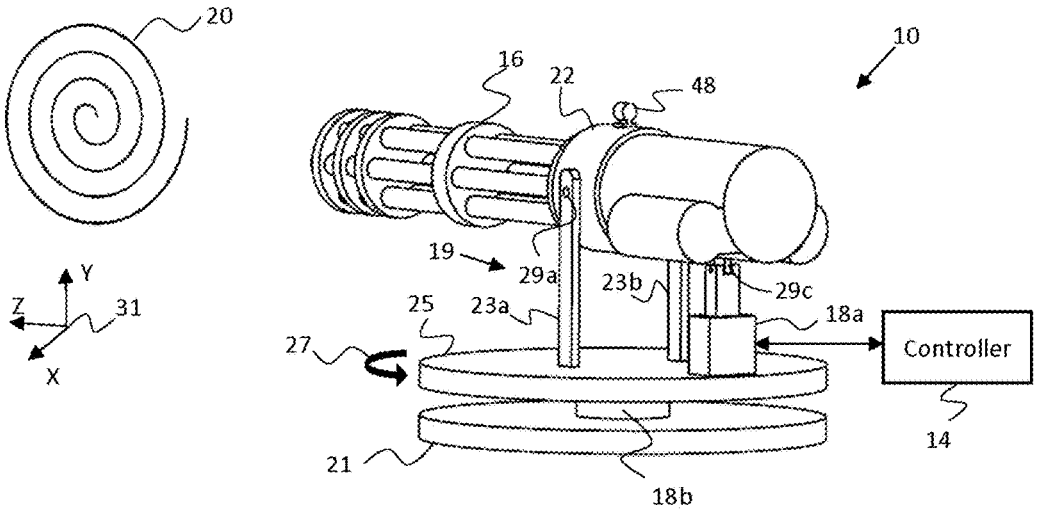
FIG. 1A depicts a perspective view of a controllable firing pattern firearm system producing a spiral firing pattern in accordance with embodiments of the invention.

The present invention has utility as a controllable firing pattern firearm system for firing projectiles across a wider area of a target in a controlled fashion to more evenly distribute the projectiles on the target area, making the most efficient and effective use of ammunition, better than what can be achieved by manual operation. The present invention is particularly advantageous for the war on terror, against terrorist combatants, terrorist operated ground vehicles, ships, aircraft, unmanned drones, and in traditional military operations. The following description of various embodiments of the invention is not intended to limit the invention to those specific embodiments, but rather to enable any person skilled in the art to make and use this invention through exemplary aspects thereof. Further, it should be appreciated that although embodiments of the invention described herein are illustrated with reference to the use of a Gatling gun, any firearm, and more specifically, any rapidly firing firearm, may be substituted for the Gatling gun without deviating from the scope of the present invention.

It is to be understood that in instances where a range of values are provided that the range is intended to encompass not only the end point values of the range but also intermediate values of the range as explicitly being included within the range and varying by the last significant figure of that range. By way of example, a recited range of 1 to 4 is intended to include 1-2, 1-3, 2-4, 3-4, and 1-4.

With reference now to the drawings, and in particular FIGS. 1A through 7 thereof, examples of the instant controllable firing pattern firearm system employing the principles and concepts of the present controllable firing pattern firearm system and generally designated by the reference number 10 will be described.

Referring to FIGS. 1A through 5, particular inventive embodiments of a controllable firing pattern firearm system 10 is illustrated. The controllable firing pattern firearm system 10 is generally configured to produce a designated firing pattern on a target while the firearm is firing. The firearm system 10 generally includes a firearm 16, such as a Gatling gun, one or more actuators (18*a*, 18*b*) operatively coupled to the firearm 16 to adjust at least one of a position and orientation of the firearm 16, and a controller 14 controlling the one or more actuators to produce a designated firing pattern on the target as the firearm is firing. The firearm 16 may include components of a standard firearm illustratively including one or more barrels, a chamber, a firearm trigger, a magazine, a grip, a rotor assembly if the gun is a mini-gun, and a stock. The one or more actuators (18*a*, 18*b*) are configured to adjust at least one of a position and orientation of the firearm based on commands from the controller 14. The one or more actuators (18*a*, 18*b*) may be electrical actuators, pneumatic actuators, hydraulic actuators, or a combination thereof. In particular embodiments, the one or more actuators (18*a*, 18*b*) are servo-actuators including at least one of an electrical servo-actuator, pneumatic servo-actuator, or hydraulic servo-actuator. In addition, the actuators (18*a*, 18*b*) may be linear actuators 18*a* (e.g., prismatic joints, screw joints, cylindrical joints), or rotational actuators 18*b* (e.g., revolute joints). In specific embodiments, the actuators (18*a*, 18*b*) provide precision positional and/or angular control to adjust the firearm with a resolution in the range of 0.05 micrometers to 1.0 micrometer for a linear actuator 18*a* and 0.05 degrees to 1 degree for a rotational actuator 18*b*. Likewise, the actuators (18*a*, 18*b*) may be actuated at a rate in the range of 1,000 rotations/minute to 6,000 rotations per minute for a rotational actuator 18*b* or 0.5 inches/second to 5 inches/second for a linear actuator 18*a*. The actuators (18*a*, 18*b*) may further include one or more encoders to provide positional or rotational feedback of the actuators (18*a*, 18*b*) to the controller 14. In specific embodiments, the one or more actuators (18*a*, 18*b*) are servomotors including at least one of a linear servomotor and/or a rotational servomotor.

The controller 14 is configured to generate commands for the one or more actuators (18*a*, 18*b*) to adjust the firearm 16 to produce a desired firing pattern on the target based on one or more inputs from a user and/or other sensors. The controller 14 may include hardware (e.g., processor, memory, I/O), software, data, and utilities, for converting input from the user and other sensors into the plurality of commands for the one or more actuators (18*a*, 18*b*). In specific embodiments, the controller 14 includes a firing pattern software module that utilizes user-specified inputs and/or sensor inputs, as further described below, into the commands for the actuators (18*a*, 18*b*). The software module may further include a kinematic model of the actuators (18*a*, 18*b*) and the firearm 16 and use inverse kinematics, along with the user-specified inputs and/or sensor inputs, to calculate the commands for the actuators (18*a*, 18*b*) to produce the designated firing pattern on the target.

The designated firing pattern may vary extensively based on several factors illustratively including, a user's preference, the type of target, the size of a target, the distance of a target from the firearm 16, how fast a target is travelling, and a direction in which the target is travelling. Illustrative examples of firing patterns include a star pattern, a zigzag pattern, a circular pattern, a square pattern, and an X-pattern. In specific embodiments, the designated firing pattern is a spiral firing pattern 20 as shown in FIG. 1A. The controller 14 may generate commands for the actuators (18*a*, 18*b*) to produce the spiral firing pattern 20, where the commands may start the firearm 16 at a center point of a spiral, spiral the firearm 16 outwards to a maximum diameter, and then spiral the firearm 16 inwards back to the center point. The maximum diameter of the spiral firing pattern 20 and the angle of deviation from the center point of the spiral (i.e., density/number of spirals in the spiral firing pattern 20) may be adjusted based on user inputs and/or sensor inputs as further described below. A spiral firing pattern 20 is particularly advantageous as the projectiles are more evenly distributed across a wider area of the target greatly increasing the odds of destroying the target. In specific embodiments, the maximum diameter of the spiral firing pattern can range and be adjusted between 1 foot and 50 feet.

Figure 1B:
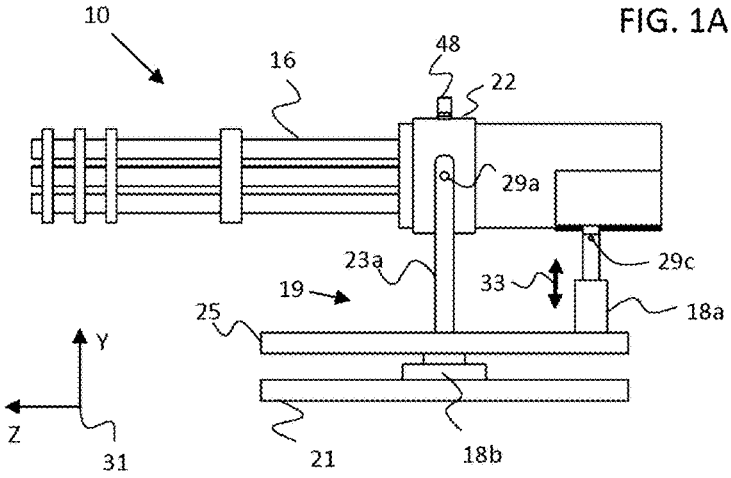
FIG. 1B depicts a side view of the controllable firing pattern firearm system in accordance with embodiments of the invention.
Figure 1C:
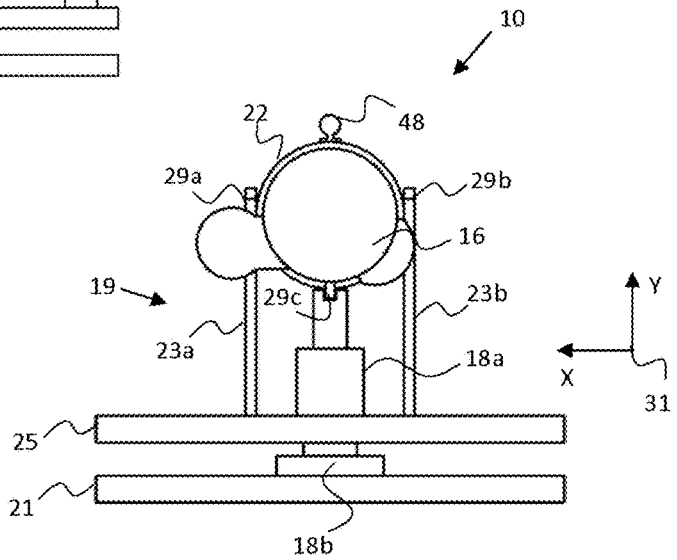
FIG. 1C depicts a rear view of the controllable firing pattern firearm system in accordance with embodiments of the invention.

With reference to FIGS. 1A to 1C, a particular inventive embodiment of a controllable firing pattern firearm system 10 is shown. For the purposes of describing direction and orientation herein, a coordinate system 31 is shown. The Z-axis corresponds to a longitudinal axis of the firearm 16 as the firearm is fired towards the center of the spiral firing pattern 20. The Y-axis corresponds to a perpendicular axis relative to the Z-axis (up-down), and the X-axis corresponds to a lateral axis relative to the Y-axis and Z-axis (side-side). The controllable firing pattern firearm system 10 includes a platform 21, a stand 25, a rotary actuator 18*b* positioned between the platform 21 and the stand 25, a support assembly 19 disposed on the stand 25 and supporting a firearm 16, and a linear actuator 18*a* disposed on the stand and operatively coupled to a portion of the firearm 16. In some embodiments, the platform 21 is a floor of a structure, such as the floor of a helicopter cabin. In other embodiments, the platform 21 is a structure for resting and/or aiming the actuators (18*a*, 18*b*) and firearm 16. The stand 25 supports the support assembly 19 and linear actuator 18*a* thereon such that the stand 25, support assembly 19, linear actuator 18*a*, and the firearm 16 are rotated (as seen by rotating arrow 27 in FIG. 1A) by the rotary actuator 18*b* about an axis parallel with the Y-axis. The support assembly 19 is configured to support the firearm 16 on the stand 25 and permit the firearm 16 to pivot about an axis parallel with the X-axis. The support assembly 19 may include one or more brackets (23*a*, 23*b*) having a first end connected to the stand 25 and a second end connected to a first portion of the firearm 16. The second end of the brackets (23*a*, 23*b*) may connect to the firearm 16 by a hinge (29*a*, 29*b*) to permit the firearm 16 to rotate about an axis parallel with the X-axis. A securement feature 22 may further facilitate the assembly of the brackets (23*a*, 23*b*) to the firearm 16 as further described below. The linear actuator 18*a* disposed on the stand 25 is operatively coupled to a second portion of the firearm 16 to adjust the orientation of the firearm 16 about the hinges (29*a*, 29*b*). The linear actuator 18*a* may likewise be coupled to the firearm 16 by way of a hinge 29*c* to allow the firearm 16 to rotate about the hinge 29*c* as the linear actuator 18*a* linearly actuates (as shown by translating arrow 33 in FIG. 1B). In a particular embodiment, the support assembly 19 is positioned in front of the linear actuator 18*a* on the stand 25 (e.g., the support assembly 19 is positioned more towards the muzzle compared to the position of the linear actuator 18*a*). In other embodiments, the linear actuator 18*a* is positioned in front of the support assembly 19.

In a particular embodiment, the one or more securement features 22 are configured to removably secure the firearm 16 to the support assembly 19 and/or actuators (18*a*, 18*b*). The one or more securement features 22 may illustratively include a coupler, a clip, a clamp, a latch, a zip-tie, a pivot-pin, a hinge, a bayonet mount, a dovetail joint, a sleeve, adhesives, fastening elements such as screws, rivets, pins, and combinations thereof. In specific embodiments, the securement feature 22 is custom made for a particular firearm, while in other embodiments the securement feature 22 is adaptable to several types of firearms. As shown in FIGS. 1A to 1C, the securement feature 22 is a rigid sleeve rigidly assembled about the stock of the firearm 16. In some embodiments, the securement feature 22 is simply a fastening element, clip, clamp, pivot pin, or hinge present on one end of the one or more brackets (23*a*, 23*b*) and/or actuators (18*a*, 18*b*) for direct assembly to a mating feature on the firearm 16.

Figure 2:
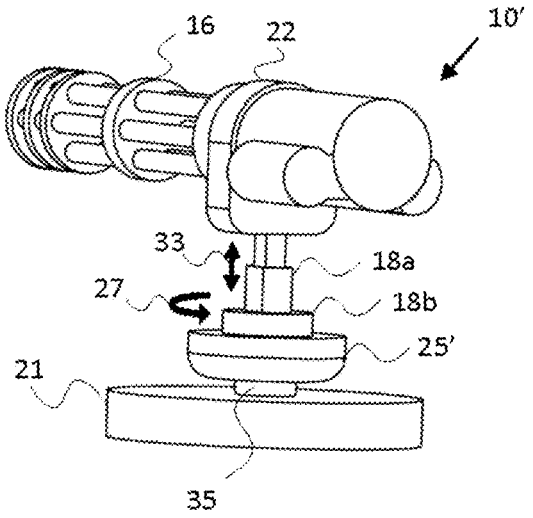
FIG. 2 depicts a perspective view of a second configuration of the controllable firing pattern firearm system in accordance with embodiments of the invention.

With reference to FIG. 2, another specific inventive embodiment of a controllable firing pattern firearm system 10' is illustrated. The controllable firing pattern firearm system 10' includes a stand 25' supporting a rotary actuator 18*b* and a linear actuator 18*a* assembled in series. The linear actuator 18*a* or rotary actuator 18*b* being coupled to the firearm 16 by way of a securement feature 22 depending on the order of the series of the linear actuator 18*a* and rotary actuator 18*b*. In one embodiment, the rotary actuator 18*b* is positioned below the linear actuator 18*a*, where the rotary actuator 18*b* rotates the linear actuator 18*a* about an axis parallel with the Y-axis (as shown by rotating arrow 27). The linear actuator 18*a* then directly translates the firearm 16 along an axis parallel with the Y-axis. In another embodiment, the linear actuator 18*a* is positioned below the rotary actuator 18*b* to translate the rotary actuator 18*b* along an axis parallel with the Y-axis, and the rotary actuator 18*b* directly rotates the firearm 16 about an axis parallel with the Y-axis. In either case, the firearm 16 can be aimed towards any X-Y coordinate in space to produce a designated firing pattern on the target.

The controllable firing pattern firearm system 10' may further include at least one targeting joint 35 as part of the platform 21 on which the actuators (18*a*, 18*b*) and firearm 16 can pivot. The targeting joint 35 may be a spherical joint, pivot pin, or other rotational or linear joint that can be adjusted and locked into a position and/or orientation. The targeting joint 35 permits the actuators (18*a*, 18*b*) and firearm 16 to be adjusted in at least one of a position and orientation to aim the actuators (18*a*, 18*b*) and firearm 16 towards a target independent of the execution of the firing pattern. The targeting joint 35 may further be part of a more complex targeting system (e.g., a manipulator arm) having one or more links and joints that are manually or automatically controlled to aim the actuators (18*a*, 18*b*) and firearm 16 towards a target. Therefore, an operator can grossly aim and follow a target by way of the targeting joint 35 while the controllable firing pattern firearm system 10' produces the designated firing pattern.

Figure 3:
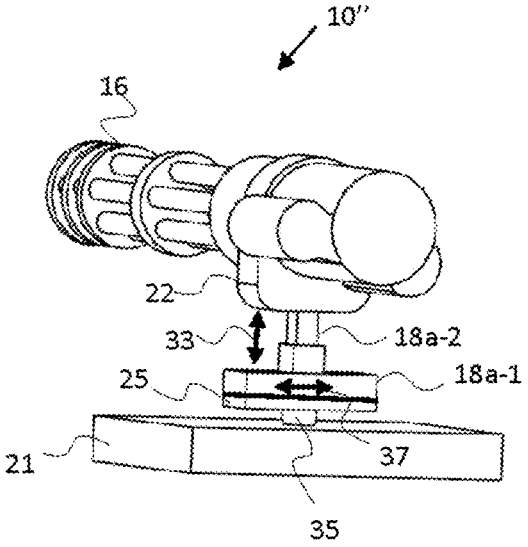
FIG. 3 depicts a perspective view of a third configuration of the controllable firing pattern firearm system in accordance with embodiments of the invention.

With reference to FIG. 3, another particular inventive embodiment of a controllable firing pattern firearm system 10" is shown. The controllable firing pattern firearm system 10" includes a stand 25, a first linear actuator 18*a*-1, a second linear actuator 18*a*-2 connected to the first linear actuator 18*a*-1, and a firearm 16 coupled to the second linear actuator 18*a*-2 by way of a securement feature 22. The stand 25 supports the first linear actuator 18*a*-1, second linear actuator 18*a*-2, and firearm 16. The first linear actuator 18*a*-1 adjusts the position of the second linear actuator 18*a*-2 along an axis parallel with the X-axis. The second linear actuator 18*a*-2 adjusts the position of the firearm 16 along an axis parallel with the Y-axis. Therefore, the firearm 16 can be aimed towards any X-Y coordinate in space to produce a designated firing pattern on the target. The controllable firing pattern firearm system 10" may further include a targeting joint 35 as described above.

Figure 4:
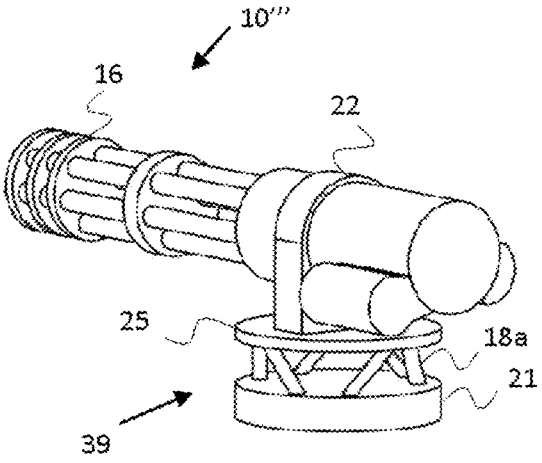
FIG. 4 depicts a perspective view of a fourth configuration of the controllable firing pattern firearm system in accordance with embodiments of the invention.

With reference to FIG. 4, another specific inventive embodiment of a controllable firing pattern firearm system 10''' is shown. The controllable firing pattern firearm system 10''' includes a firearm 16 assembled to a 1-6 degree of freedom Gough-Stewart platform 39. The Gough-Stewart platform 39 includes a platform 21, a stand 25, and a plurality of linear actuators 18*a* positioned between the platform 21 and the stand 25. The firearm 16 is disposed on the stand 25 such that the Gough-Stewart platform 39 can adjust at least one of a position and orientation of the firearm 16 based on commands from the controller 14. A securement feature 22 may facilitate the assembly of the firearm 16 to the Gough-Stewart platform 39. Note, the 'platform' of a conventional Gough-Stewart platform is being replaced with the stand 25 for the purposes of naming consistency between the embodiments described herein.

Figure 5:
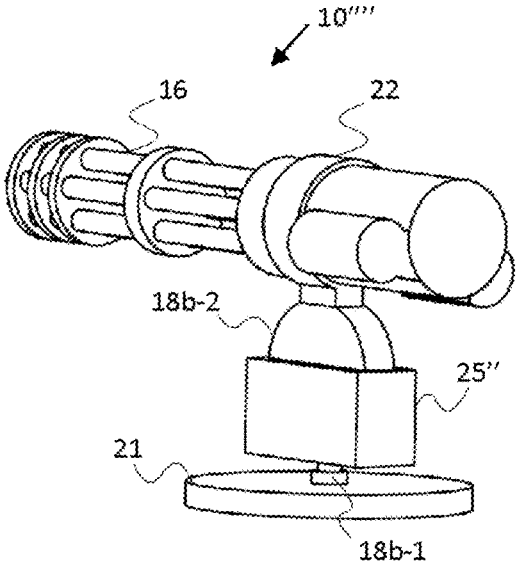
FIG. 5 depicts a perspective view of a fifth configuration of the controllable firing pattern firearm system in accordance with embodiments of the invention.

With reference to FIG. 5, a further specific inventive embodiment of a controllable firing pattern firearm system 10'''' is shown. The controllable firing pattern firearm system 10'''' includes a platform 21, a stand 25", a first rotary actuator 18*b*-1 for rotating the stand about an axis parallel to the Y-axis, and a second rotary actuator 18*b*-2 situated on/within the stand 25" for rotating the firearm 16 about an axis parallel to the X-axis. The stand 25" may further include the components (worm gears, servo-motor(s), spindles, encoders) that make up the second rotary actuator 18*b*-2 therewithin. A securement feature 22 may facilitate the assembly of the firearm 16 to second rotary actuator 18*b*-2. It should be appreciated, that the configuration of the first rotary actuator 18*b*-1 and second rotary actuator 18*b*-2 may be inverted where the first rotary actuator 18*b*-1 is secured to the firearm 16 to rotate the firearm 16 about an axis parallel to the Y-axis, and the second rotary actuator 18*b*-2 rotates the first rotary actuator about an axis parallel to the X-axis.

The controllable firing pattern firearms (10, 10', 10", 10''') may further include a linear bearing (not shown) situated between: a) at least one of the securement feature 22, the actuators (18*a*, 18*b*), or the support assembly 19; and b) the firearm 16. The linear bearing is disposed to allow the firearm 16 to naturally recoil, to an extent, without worry that a securement feature 22, support assembly 19, and/or actuators (18*a*, 18*b*) will disconnect from the firearm 16.

Figure 6A:
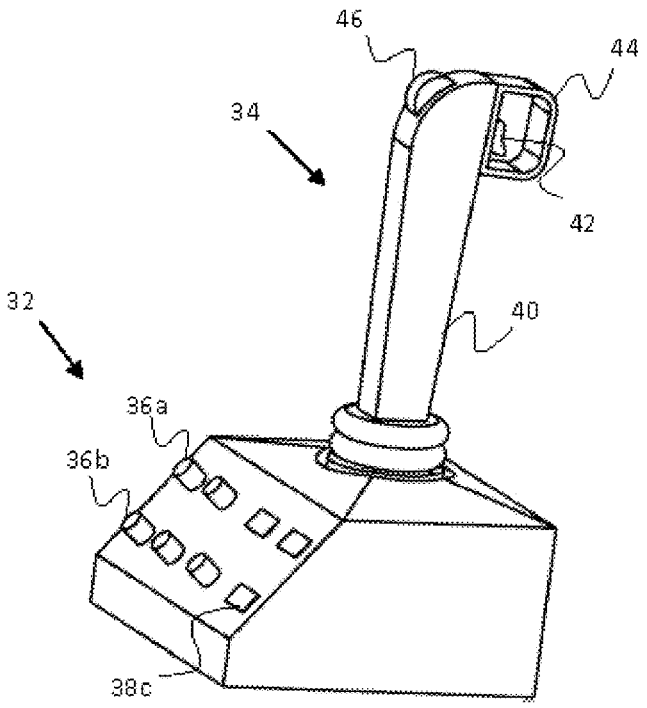
FIGS. 6A and 6B depict a control panel and joystick in accordance with embodiments of the invention, where
Figure 6B:
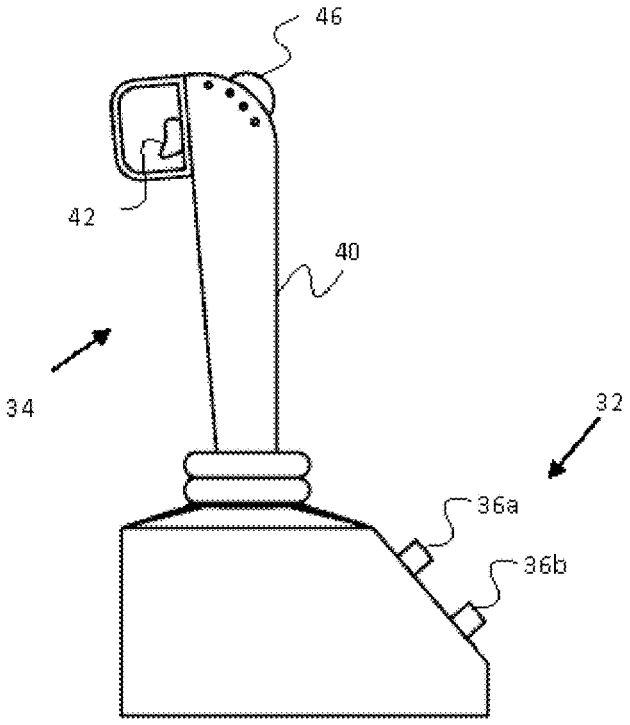
Figure 6C:
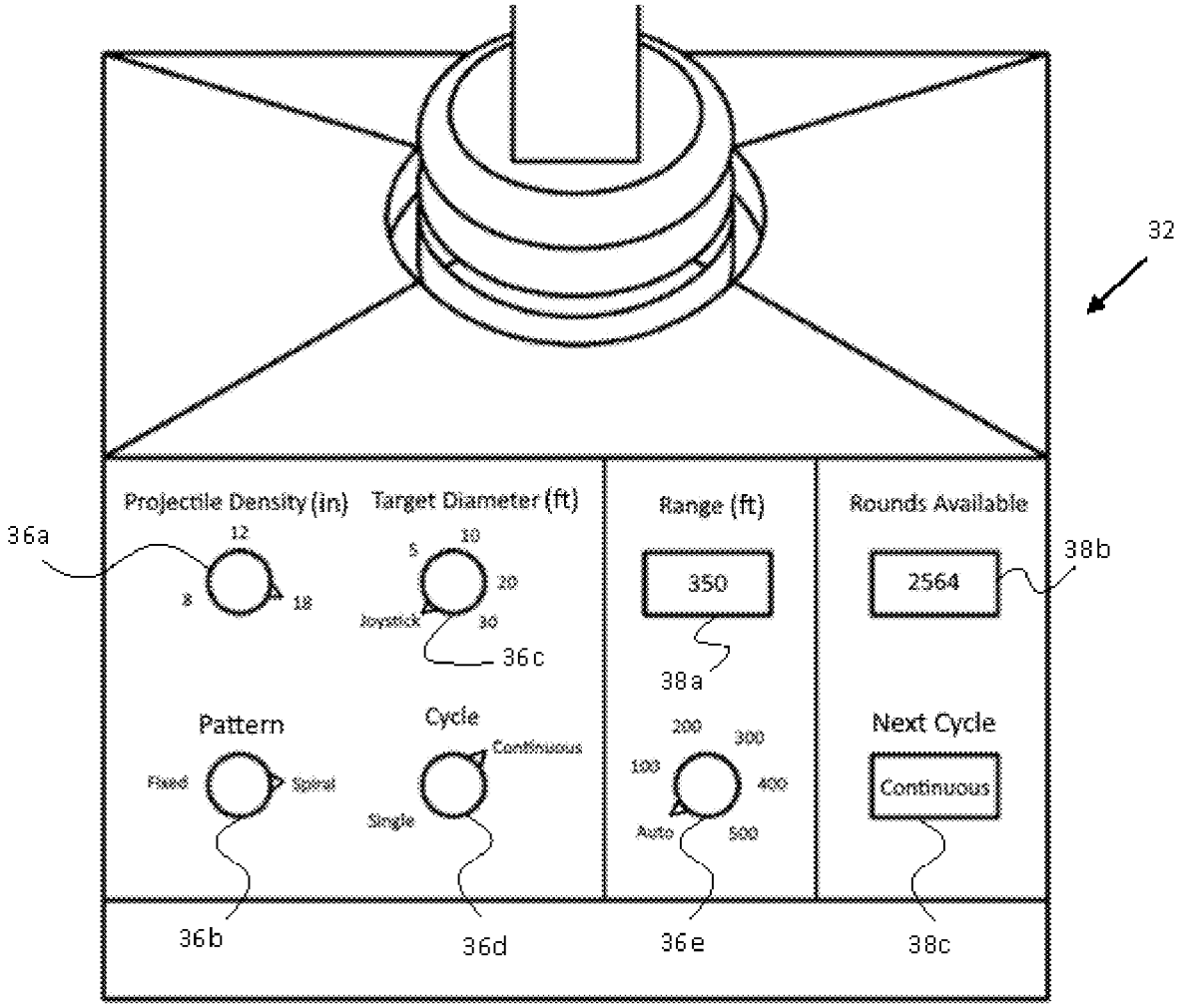
FIG. 6C depicts a detailed front view of the control panel shown in FIGS. 6A and 6B in accordance with embodiments of the invention.

With reference now to FIGS. 6A to 6C, in particular inventive embodiments the controllable firing pattern firearm system 10 further includes a control panel 32 and a joystick 34, where FIG. 6A is a perspective view thereof, FIG. 6B is a side view thereof, and FIG. 6C is a detailed front view of the control panel 32. The control panel 32 includes a plurality of control input mechanisms (36*a*, 36*b*, 36*c*, 36*d*, 36*e*) (e.g., control knobs, dials, buttons) to permit a user to provide user specified-input to the controller 14 for calculating the commands for the actuators (18*a*, 18*b*) as described above. The joystick 34 is used to facilitate the aiming of the firearm 16 towards a target. The joystick 34 may include a handle 40, a trigger 42, a trigger guard 44, and a dial 46. The dial 46 allows the user to make quick adjustments to one or more firing parameters as further described below.

The control panel 32, with reference to FIG. 6C, includes the plurality of control input mechanisms (36*a*, 36*b*, 36*c*, 36*d*, 36*e*) to permit the user to adjust/input several firing parameters, which are used by the controller 14 to generate the commands for the actuators (18*a*, 18*b*) to produce a designated firing pattern on the target. The control panel 32 may include a first control input mechanism 36*a* to permit a user to adjust a projectile firing density. The projectile firing density is the average distance between projectiles at the level of the target (e.g., projectiles spaced 8, 12, or 18 inches apart about the spiral firing pattern 20 on the target). A higher projectile firing density (i.e., projectiles spaced 8 inches apart) results in more closely spaced projectiles, making it easier to hit small targets such as drones; however a higher projectile firing density consumes ammunition at a higher rate. A second control input mechanism 36*b* permits a user to toggle between a non-pattern firing mode (e.g., fixed towards a single point on the target) and a pattern firing mode (e.g., spiral firing pattern 20). A third control input mechanism 36*c* permits a user to input and adjust a size of the firing pattern (i.e., size of the target) (e.g., 5 feet, 10 feet, 20 feet, and 30 feet). A fourth control input mechanism 36*d* allows the user to toggle between a single cycle firing mode (e.g., produce one spiral pattern) and a continuous cycle firing mode (e.g., repeat the spiral firing pattern 20 until terminated by the user). A fifth control input mechanism 36*e* allows the user to adjust a distance from the firearm 16 to a target (i.e., range) (e.g., 100 feet, 200 feet, 300 feet, 400 feet, and 500 feet). The fifth control input mechanism 36*e* may also be set to auto, where a distance measurement sensor 48 (as shown in FIGS. 1A to 1C) is used to automatically determine the distance to the target as further described below. A sixth control input mechanism (not shown) may permit the user to change the firing pattern (e.g., spiral firing pattern, zig-zag pattern).

Based on the firing parameter inputs from the user, the controller 14 determines the commands for the actuators (18*a*, 18*b*) to produce the designated firing pattern. For example, in one embodiment, with reference to projectile firing density, if the user chooses a higher projectile firing density (e.g., projectiles spaced 8 inches apart) compared to a lower projectile firing density (e.g., projectiles spaced 12 inches apart), then the actuators (18*a*, 18*b*) are commanded to actuate at a slower rate to achieve said higher projectile density on the target. In another example, with reference to adjusting the size of the firing pattern (i.e., size of the target), if the user increases the target diameter, then the maximum diameter of the firing pattern produced on the target is increased. The user may likewise set the size of a target, where the maximum diameter of the firing pattern remains the same on the target, but the angle of deviation from the center of the firing pattern is varied based on the distance of the firearm 16 to the target. For instance, if the distance from the firearm 16 to the target decreases, then the angle of deviation is increased because the target is closer to the firearm 16. This is advantageous as the same amount of ammunition can be expended for a single firing cycle regardless of the distance between the target and the firearm 16. In a further example, the degree to which the actuators (18*a*, 18*b*) adjust the firearm 16 is dependent on the distance to the target and the inputted size of the target. A longer distance to the target will inherently produce smaller movements of the firearm 16 to produce the designated firing pattern on the target. The controllable firing pattern firearm system 10 may further include a tracking system to track the target and adjust the firing parameters accordingly.

The control panel 32 may further include one or more displays (38*a*, 38*b*, 38*c*) to display information regarding the controllable firing pattern firearm system 10. The control panel 32 may include a first display 38*a* for displaying the range of a target from the firearm 16, a second display 38*b* displaying the available rounds remaining, and a third display 38*c* for displaying the number of rounds to be expended in the next firing cycle. Display 38*c* may also display which firing cycle mode is selected. For example, in the event the continuous cycle firing mode is selected, then 'CONT' appears on the display 38*c*.

In specific inventive embodiments, the controllable firing pattern firearm system 10 further includes a distance measurement sensor 48 (as shown in FIGS. 1A to 1C). The distance measurement sensor 48, illustratively including a rangefinder, is configured to automatically measure a distance from the firearm 16 to a target. In a particular embodiment, the distance measurement sensor 48 is attached to a portion of the controllable firing pattern firearm system 10 and moves in concert with the firearm 16 as the firearm 16 is aimed. However, it should be appreciated that the distance measurement sensor 48 does not necessarily have to be positioned on the controllable firing pattern firearm system 10 as long as the relative positions of where the firearm 16 is aimed towards the target is known relative to where the distance measurement sensor 48 is aimed towards the target. Therefore, the user does not have to guess a distance from the firearm 16 to the target, where the distance measurements sensor 48 can provide the distance measurement directly to the controller 14 and update the distance in real-time to produce a designated firing pattern on the target. In situations where the distance measurement sensor 48 cannot lock onto the target (e.g., in the case of drones flying at high speed and hard to track), then the distance can be manually selected by the user with the control panel 32 or with the dial 46 on the joystick.

In a particular embodiment, the controller 14 may further receive input from a moving vessel (e.g., aircraft, helicopter, vehicle, boat) on which the controllable firing pattern firearm system 10 is situated thereon. For example, if the firearm system 10 is situated on an aircraft, then the controller 14 may further receive input as to the aircrafts velocity and altitude. The velocity and altitude may be updated in the controller 14, in real-time, to aid in generating the commands for the actuators (18*a*, 18*b*) to produce the designated firing pattern on the target, as the vessel is moving.

Figure 7:
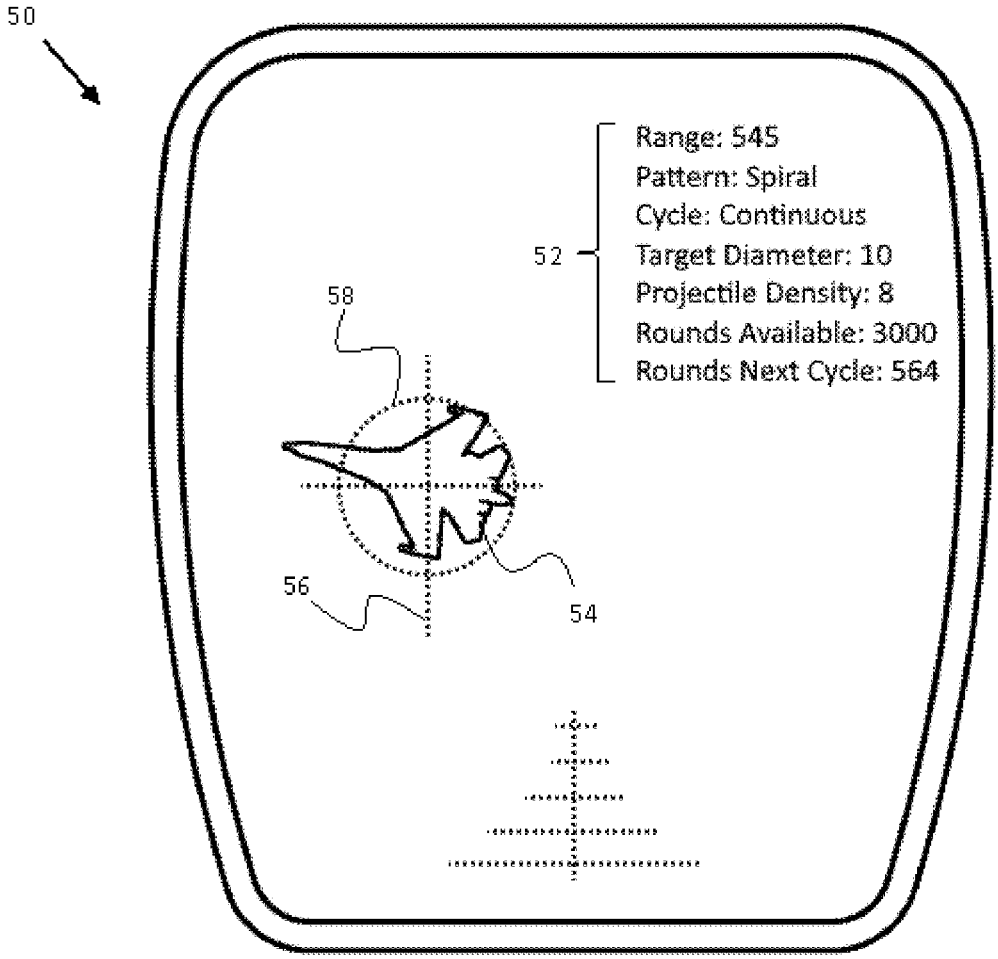
FIG. 7 depicts a heads-up-display unit to facilitate the aiming of the firearm towards a target in accordance with embodiments of the invention.

With reference to FIG. 7, the controllable firing pattern firearm system 10 may further include a heads-up-display unit (HUD) 50. The HUD 50 may be similar to conventional heads-up-display units for fighter pilots and situated on the user's helmet. The HUD 50 is in data communication with the controller 14 to provide data to the user including the aforementioned firing parameters (as shown in the bracket 52 in FIG. 7). The user also utilizes the HUD 50 to facilitate the aiming of the firearm 16 towards a target. More specifically, the user may identify and track a target 54 (e.g., a fighter jet), and place crosshairs 56 on the target 54. A circle 58 around the crosshairs 56 shows the area that will be covered by projectiles. If the user adjusts the target diameter, then the circle 58 will increase or decrease to show a larger or smaller area covered by the projectiles. The user, either before, during, or after aiming the firearm 16 chooses the desired firing parameters and fires the firearm 16 to produce designated firing pattern on the target. It should be appreciated, that a display unit with characteristics similar to the HUD 50 may be positioned on a dashboard or other surface if the controllable firing pattern firearm system 10 is used manually on board a helicopter, vehicle, or ship.

Operation of the Controllable Firing Pattern Firearm System

In a specific inventive embodiment, a method for firing a spiral firing pattern 20 on a target with the controllable firing pattern firearm 10 is provided. The method includes determining a distance from the firearm to a target and inputting the distance in the controller. Inputting a desired projectile firing density in the controller 14 and a desired size of the firing pattern (i.e., size of the target) in the controller 14. The controller 14 then calculates commands for the one or more actuators (18*a*, 18*b*) to produce a spiral firing pattern 20 based on the distance, the size, and the firing density. The user then engages the target by firing the firearm 16 at the target, wherein the actuators (18*a*, 18*b*), based on commands from the controller 14, adjust the firearm 16 to produce the spiral firing pattern 20 on the target.

Example

The following is but one example of operating the controllable firing pattern firearm system 10 as described above. First, a user selects a fixed or spiral firing pattern mode. The fixed mode is a conventional firing mode, where the firearm 16 fires projectiles towards a single point on a target. The spiral firing pattern mode will produce a spiral firing pattern 20 on the target. Next, if a spiral firing pattern mode was chosen, the user selects a single cycle or a continuous cycle. If a single cycle is chosen, the controllable firing pattern firearm system 10 will execute a single spiral firing pattern 20 (i.e., start the firing at a center point of the spiral or 0 degrees, spiraling the firearm outwards to a maximum diameter, then spiraling the firearm inwards back to the center point). If a continuous mode is chosen, then the controllable firing pattern firearm system 10 will continuously repeat the spiral firing pattern 20 until the user terminates the firing. Next, the user selects the projectile firing density (e.g., projectiles spaced 8, 12, or 18 inches apart), and the diameter of the target area to be covered (e.g., 5, 10, 15, 20, or 30 feet). If the user chooses to have the dial 46 on the joystick 34 adjust the diameter, then the user can select the diameter with the dial 46 on the joystick 34 and update the diameter while firing if needed. Subsequently, the user sets the measurement distance sensor 48 to auto or manual. If the user selects manual, then the range is entered manually. Next, the user identifies the target in space, and places crosshairs 56 on the target using the HUD 50. The range to the target appears on the HUD 50, as well as any other firing parameters (as shown at 52 in FIG. 7). The HUD 50 displays the target in the crosshairs 56, and a circle 58 around the crosshairs 56 shows the area that will be covered by projectiles. The number of rounds available and/or the number of rounds to be expended in the upcoming cycle is also shown on the HUD 50 and/or the control panel 32. If a continuous cycle was chosen, then the HUD 50 and/or control panel 32 displays 'CONT' or 'CONTINUOUS'. The user then engages the target where the controllable firing pattern firearm system 10 produces the spiral firing pattern 20 accordingly.

Other Embodiments

While at least one exemplary embodiment has been presented in the foregoing detail description, it should be appreciated that a vast number of variations exist. It should also be appreciated that the exemplary embodiment or exemplary embodiments are only examples, and are not intended to limit the scope, applicability, or configuration of the described embodiments in any way. It should be understood that various changes may be made in the function and arrangement of elements without departing from the scope as set forth in the appended claims and the legal equivalents thereof.

What is claimed is:

1. A controllable firing pattern firearm system comprising:

a firearm;

one or more actuators operatively coupled with the firearm to adjust at least one of a position and orientation of the firearm; and a controller controlling the one or more actuators to produce a designated firing pattern on a target as the firearm is firing, wherein the designated firing pattern is a spiral firing pattern.

2. A controllable firing pattern firearm system comprising:

a firearm;

one or more actuators operatively coupled with the firearm to adjust at least one of a position and orientation of the firearm;

a controller controlling the one or more actuators to produce a designated firing pattern on a target as the firearm is firing;

a control panel having a plurality of control input mechanisms to permit a user to provide user input to control the firearm, wherein at least one of said control input mechanisms is associated with at least a partial designation of the firing pattern and wherein the control panel further comprises a first control input mechanism to permit a user to adjust projectile firing density, a second control input mechanism to toggle between a non-pattern firing mode and a pattern firing mode, a third control input mechanism to permit a user to input a size of the firing pattern, a fourth control input mechanism to toggle between a single cycle firing mode and a continuous cycle firing mode, and a fifth control input mechanism to adjust a distance measurement from the firearm to a target.

3. The controllable firing pattern firearm system of claim 1 further comprising a joystick for facilitating the aiming of the firearm towards a target, said joystick further comprising a dial to adjust at least one of a size of the firing pattern, projectile firing density, a firing pattern mode, a cycle firing mode, or a distance from the firearm to a target.

4. The controllable firing pattern firearm system of claim 1 further comprising:

a platform and a stand;

a rotary actuator positioned between the platform and the stand to rotate the stand relative to the platform;

a support assembly disposed on the stand and supporting a first portion of the firearm; and a linear actuator disposed on the stand and coupled to a second portion of the firearm;

wherein the rotary actuator and linear actuator adjust an orientation of the firearm to produce the designated firing pattern based on commands from the controller.

5. The controllable firing pattern firearm system of claim 4 wherein the support assembly comprises one or more brackets each having a first end connected to the stand and a second end assembled to the firearm by a hinge to permit the firearm to rotate about the hinge relative to the one or more brackets.

6. The controllable firing pattern firearm system of claim 5 wherein the linear actuator is coupled to the portion of the firearm by a second hinge.

7. The controllable firing pattern firearm system of claim 6 wherein the support assembly is positioned in front of the linear actuator on the stand.

8. A controllable firing pattern firearm system comprising:

a firearm;

one or more actuators operatively coupled with the firearm to adjust at least one of a position and orientation of the firearm;

a controller controlling the one or more actuators to produce a designated firing pattern on a target as the firearm is firing; and a Gough-Stewart platform operated by the one or more actuators, wherein the firearm is operatively coupled to the Gough-Stewart platform to adjust at least one of a position and orientation of the firearm based on commands from the controller.

9. The controllable firing pattern firearm system of claim 1 wherein the controller commands the actuators to produce the spiral firing pattern by beginning at a center point of a spiral, spiraling the firearm outwards to a maximum diameter, then spiraling the firearm inwards back to the center point.

10. The controllable firing pattern firearm system of claim 9 wherein the spiral firing pattern is repeated until terminated by a user.

11. The controllable firing pattern firearm system of claim 10 wherein the maximum diameter can range from 1 foot to 50 feet.

12. A controllable firing pattern firearm system comprising:

a firearm;

one or more actuators operatively coupled with the firearm to adjust at least one of a position and orientation of the firearm;

a controller controlling the one or more actuators to produce a designated firing pattern on a target as the firearm is firing; and a heads-up-display unit, said heads-up-display unit in data communication with the controller to provide data to the user including at least one of a designated firing pattern, a distance of a target from the firearm, a size of the firing pattern, projectile firing density, firing cycle, available ammunition, and an amount of ammunition to be expended in a next firing cycle.

13. The controllable firing pattern firearm system of claim 1 wherein the one or more actuators is a servo-actuator comprising at least one of an electrical servo-actuator, pneumatic servo-actuator, or hydraulic servo-actuator.

14. The controllable firing pattern firearm system of claim 1 further comprising a distance measurement sensor in data communication with the controller, said distance measurement sensor measuring a distance from the firearm to a target, wherein the controller utilizes a measured distance from the firearm to a target to produce the designated firing pattern on the target.

15. The controllable firing pattern firearm system of claim 1 wherein the firearm is a machine gun.

16. A method for firing a spiral firing pattern on a target with a controllable firing pattern firearm system comprising a firearm, one or more actuators operatively coupled with the firearm to adjust at least one of a position and orientation of the firearm, and controller controlling the one or more actuators to produce a designated firing pattern on a target as the firearm is firing, the method comprising:

determining a distance from the firearm to a target and inputting said distance in the controller;

inputting a desired projectile firing density in the controller;

inputting a desired size of the firing pattern in the controller based on a size of the target;

calculating commands for the one or more actuators to produce a spiral firing pattern based on the distance, the size, and the firing density; and firing the firearm at the target, wherein the actuators, based on commands from the controller, adjust the firearm to produce the spiral firing pattern on the target.

17. The method of claim 16 further comprising updating the distance from the firearm to the target with a distance measurement sensor as the firearm is being fired to aid in the calculation of the commands for the one or more actuators.

18. The method of claim 17 further comprising updating a velocity and an altitude of a moving vessel on which the firearm is situated thereon to aid in the calculation of the commands for the one or more actuators.

* * * * *